US012453410B2

(12) United States Patent
Doerfler et al.

(10) Patent No.: US 12,453,410 B2
(45) Date of Patent: Oct. 28, 2025

(54) PAINT BRUSH HANDLE WITH INTEGRATED HANGER ASSEMBLY

(71) Applicant: The Wooster Brush Company, Wooster, OH (US)

(72) Inventors: Matthew Joseph Doerfler, Wooster, OH (US); John L. Scott, Sr., Wooster, OH (US); James M. Byrne, Wooster, OH (US)

(73) Assignee: The Wooster Brush Company, Wooster, OH (US)

( * ) Notice: Subject to any disclaimer, the term of this patent is extended or adjusted under 35 U.S.C. 154(b) by 0 days.

(21) Appl. No.: 18/776,329

(22) Filed: Jul. 18, 2024

(65) Prior Publication Data

US 2024/0365970 A1 Nov. 7, 2024

Related U.S. Application Data

(62) Division of application No. 17/846,390, filed on Jun. 22, 2022, now Pat. No. 12,082,686.

(60) Provisional application No. 63/214,034, filed on Jun. 23, 2021.

(51) Int. Cl.
*A46B 17/02* (2006.01)
*A46B 5/02* (2006.01)

(52) U.S. Cl.
CPC ..... *A46B 17/02* (2013.01); *A46B 5/02* (2013.01); *A46B 2200/202* (2013.01)

(58) Field of Classification Search
CPC ..... A46B 2200/405; A46B 2200/202; A46B 17/02; A46B 5/02
USPC ..... 248/110, 113, 691, 692, 301, 302, 308, 248/339, 341; 15/22.1, 159.1, 143.1, 15/144.1, 246
See application file for complete search history.

(56) References Cited

U.S. PATENT DOCUMENTS

| | | | | |
|---|---|---|---|---|
| 888,896 A | | 5/1908 | Howard | |
| 1,206,010 A | * | 11/1916 | Mackeever | A46B 17/02 248/685 |
| 1,215,052 A | | 2/1917 | Nelson | |
| 1,228,774 A | | 6/1917 | Hecht | |
| 1,277,019 A | | 8/1918 | Wright | |

(Continued)

OTHER PUBLICATIONS

Photographs of a paint brush received by Applicant in Oct. 2018, which relate to the description in U.S. Pat. No. 10,051,951 (Aide).

*Primary Examiner* — Alfred J Wujciak
(74) *Attorney, Agent, or Firm* — Renner, Otto, Boisselle & Sklar, LLP.

(57) ABSTRACT

A paint brush having an integrated hanger assembly for hanging the paint brush on an object. The hanger assembly may be discrete with respect to at least the upper elongated portion of the handle, and may be provided as an insert assembly in a pocket of the handle. The hanger assembly includes a body part having a surface groove, and a hanger hinged to the body part for enabling the hanger to pivotably move between a retracted position stowed in the surface groove, and an extended position extending from the surface groove for hanging the paint brush from the object. A connection portion of the hanger may include laterally spaced apart arms and a pivot rod extending between the laterally spaced apart arms to form a connection loop. A connector may interloop with the connection loop to connect the hanger to the body part.

17 Claims, 8 Drawing Sheets

(56) References Cited

U.S. PATENT DOCUMENTS

| | | | | |
|---|---|---|---|---|
| 1,289,171 | A | 12/1918 | Hilton | |
| 1,313,515 | A | 8/1919 | Caffery | |
| 1,713,077 | A | 5/1929 | Frizl | |
| 3,131,919 | A | 5/1964 | Hartley | |
| 3,612,464 | A | 10/1971 | Harrah | |
| 4,746,042 | A | 5/1988 | King | |
| 5,044,038 | A | 9/1991 | Matkovic | |
| 5,087,014 | A | 2/1992 | Desjardin | |
| 5,406,668 | A | 4/1995 | Goodhue | |
| 5,435,037 | A | 7/1995 | Ledingham | |
| 5,636,904 | A | 6/1997 | Bell | |
| 6,244,559 | B1 | 6/2001 | Stanton | |
| 6,408,474 | B1 | 6/2002 | Husted | |
| 6,966,100 | B2 | 11/2005 | Sonne | |
| D654,783 | S | 2/2012 | Warren | |
| 8,905,363 | B2 | 12/2014 | Mccaul | |
| 9,351,561 | B2 | 5/2016 | Mccarthy | |
| 10,021,966 | B2 | 7/2018 | Ortiz | |
| 10,051,952 | B2 * | 8/2018 | Aide | A46B 15/0095 |
| 10,806,245 | B1 * | 10/2020 | Sganga | A46B 17/02 |
| 11,766,112 | B2 | 9/2023 | Byrne | |
| 2004/0026581 | A1 | 2/2004 | Hitzler | |
| 2015/0040336 | A1 | 2/2015 | Mccaul | |
| 2017/0203609 | A1 | 7/2017 | Haskins | |
| 2017/0282636 | A1 | 10/2017 | Hall | |
| 2017/0311709 | A1 * | 11/2017 | McInerney | A46B 17/02 |
| 2020/0221858 | A1 | 7/2020 | Alvarez | |
| 2020/0305591 | A1 * | 10/2020 | Byrne | A46B 17/04 |
| 2021/0023876 | A1 * | 1/2021 | Sganga | A46B 17/02 |
| 2024/0066912 | A1 | 2/2024 | Mercado | |

* cited by examiner

PAINT BRUSH HANDLE WITH INTEGRATED HANGER ASSEMBLY

RELATED APPLICATIONS

This application is a Divisional and claims priority of U.S. Non-Provisional application Ser. No. 17/846,390, which claims the benefit of U.S. Provisional Application No. 63/214,034 filed Jun. 23, 2021, which is hereby incorporated herein by reference in its entirety.

TECHNICAL FIELD

The present invention relates generally to paint brushes, and more particularly to a paint brush having an integrated hanger assembly for hanging the paint brush on an object.

BACKGROUND

A paint brush is a type of brush commonly used to apply a coating, such as paint, sealants, or the like. A paint brush usually is made by clamping bristles to a handle with a ferrule. Paint brushes generally are available in various sizes, shapes, and materials depending on the desired application. Some conventional paint brush designs incorporate a hanger to hang the paint brush from an object, such as to prevent the paint brush from falling into the paint.

SUMMARY

An aspect of the present invention provides a unique paint brush design having a handle with an integrated hanger that is pivotably movable between a retracted position for unobtrusively stowing the hanger within a groove of the handle, and an extended position for extending the hanger outwardly from the groove to enable the paint brush to be hanged on an object such as a paint bucket, tray, ladder, or the like.

According to an aspect of the present disclosure, a paint brush includes: a handle having at least an upper elongated portion; bristles operatively attached to the handle; and a hanger assembly that is discrete with respect to the upper elongated portion of the handle, and is operatively coupled to the upper elongated portion of the handle, wherein the hanger assembly includes: a body part having a surface groove; a hanger hinged to the body part such that the hanger is pivotably movable between a retracted position for stowing the hanger in the surface groove and an extended position for extending the hanger from the surface groove for hanging the paint brush from an object.

According to another aspect of the present disclosure, a paint brush includes: a handle having at least an upper elongated portion; bristles operatively attached to the handle; and a hanger assembly that is discrete with respect to at least the upper elongated portion of the handle, and is operatively coupled to the upper elongated portion of the handle, wherein the hanger assembly includes: a body part having a surface groove; a hanger having a connection portion and a hook portion, the connection portion including laterally spaced apart arms and a pivot rod extending between the laterally spaced apart arms to form a connection loop; and a connector that operatively connects the hanger to the body part and cooperates with the pivot to enable the hanger to pivotably move between a retracted position in which the hanger is stowed in the surface groove and an extended position in which the hanger extends from the surface groove for hanging the paint brush from an object.

According to another aspect of the present disclosure, a paint brush includes: an elongated handle having a flat front face, a rear face, and left and right sides respectively connecting the front and rear faces; the respective front and rear faces each having a lower portion, an intermediate portion, and an upper portion; the respective lower portions being wider than the respective intermediate portions; and the front and rear faces each having a width that tapers from the lower portion toward the intermediate portion; bristles operatively attached to the handle with a ferrule; a hanger assembly arranged in a recessed pocket in the lower portion of the flat front face, the hanger assembly comprising: a body part having a surface groove; a hanger having a connection portion and a hook portion, the connection portion including laterally spaced apart arms and a pivot rod extending between the laterally spaced apart arms to form a connection loop; and a connector that operatively connects the hanger to the body part and cooperates with the pivot to enable the hanger to pivotably move between a retracted position in which the hanger is stowed in the surface groove and an extended position in which the hanger extends from the surface groove for hanging the paint brush from an object; wherein the connector includes a pair of pins laterally spaced apart and extending from a cross-member portion of the connector; wherein the body part includes a pair of sockets laterally spaced apart and configured to receive the pair of pins; and wherein the pins are received in the sockets with one of the pins of the connector extending through the connection loop of the hanger, and the cross-member is configured to interact with the pivot rod of the hanger to pivotably secure the hanger to the body part.

According to another aspect, a method of forming a paint brush includes: providing a handle having an elongated upper portion; and operatively coupling a hanger assembly to the handle such that a hanger is hinged to a body part of the assembly for pivotable movement between a retracted position for stowing the hanger in the surface groove and an extended position for extending the hanger from the surface groove for hanging the paint brush from an object.

The following description and the annexed drawings set forth certain illustrative embodiments of the invention. These embodiments are indicative, however, of but a few of the various ways in which the principles of the invention may be employed. Other objects, advantages and novel features according to aspects of the invention will become apparent from the following detailed description when considered in conjunction with the drawings.

BRIEF DESCRIPTION OF THE DRAWINGS

The annexed drawings, which are not necessarily to scale, show various aspects of the invention.

DETAILED DESCRIPTION

Figure 1:
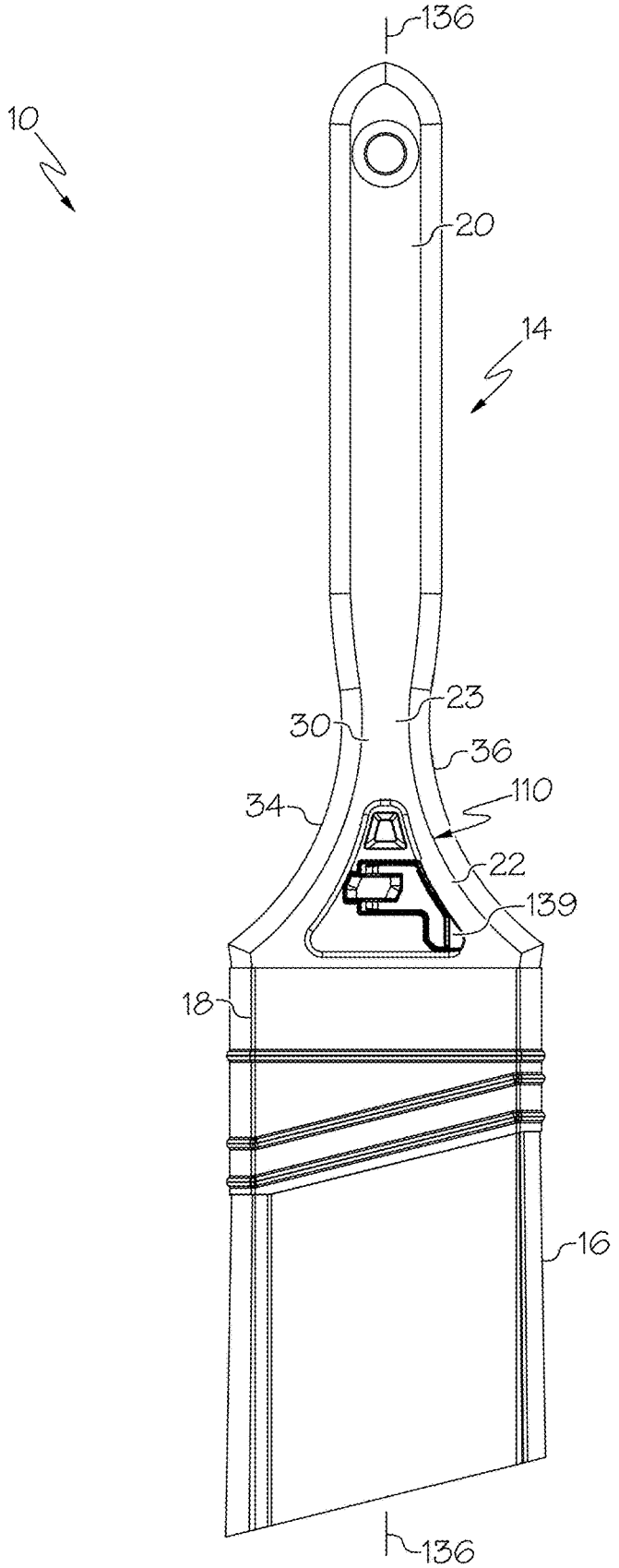
FIG. 1 is a front view of an exemplary paint brush with integrated hanger assembly according to an embodiment of the present disclosure.
Figure 2:
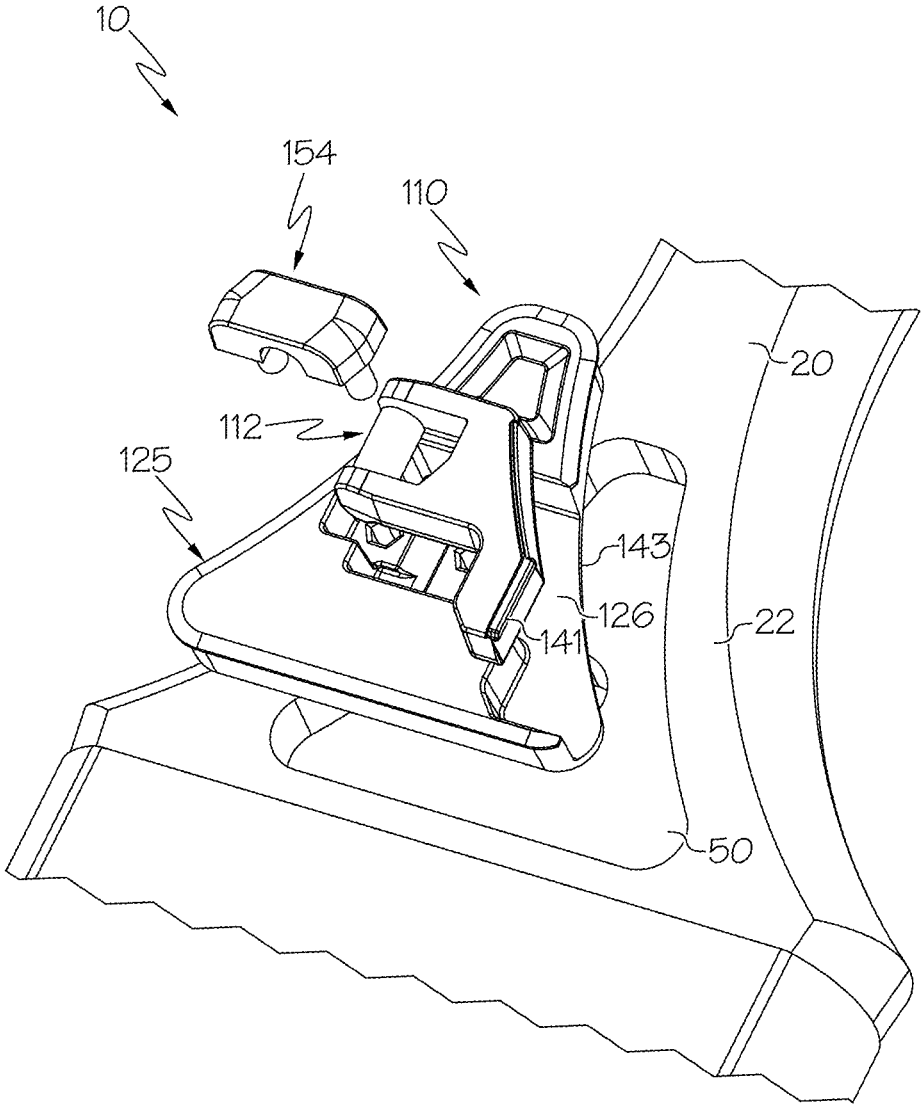
FIG. 2 is an enlarged exploded perspective view of the integrated hanger assembly in FIG. 1.
Figure 3A:
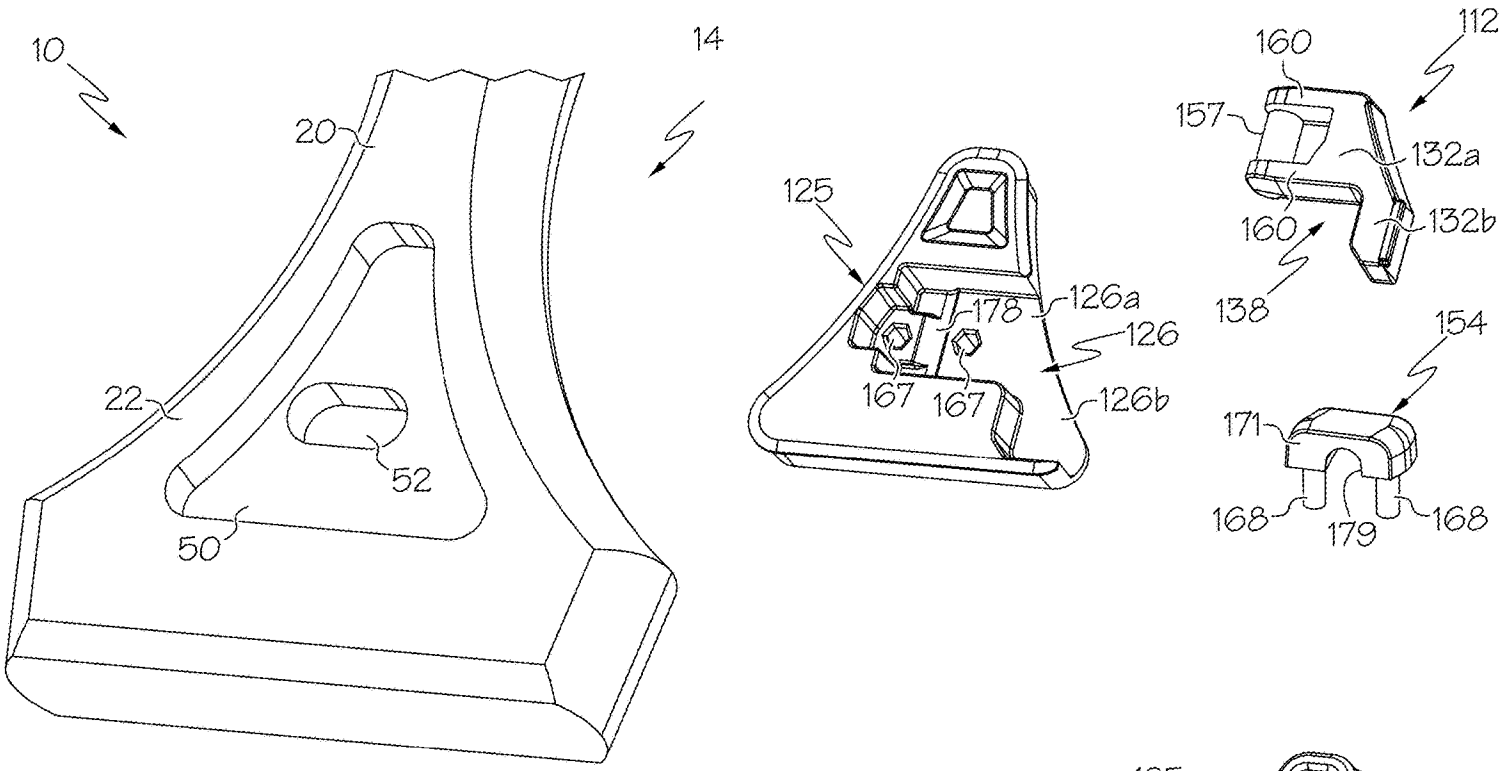
FIG. 3A is an exploded view of components of the integrated hanger assembly.
Figure 3B:
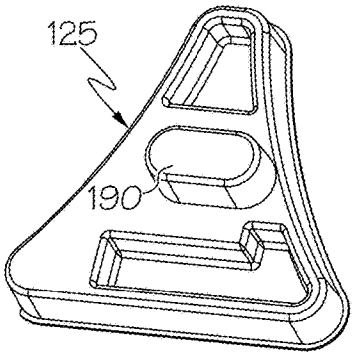
FIG. 3B is a rear view of a body part of the hanger assembly.
Figure 4:
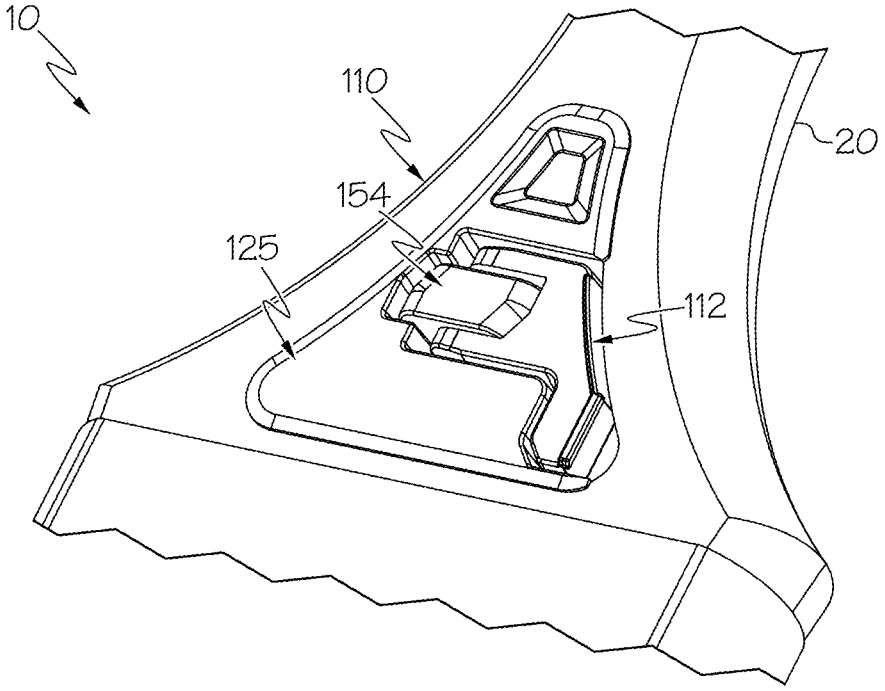
FIG. 4 is an enlarged view of the hanger assembly with a hanger in a stowed position.
Figure 5:
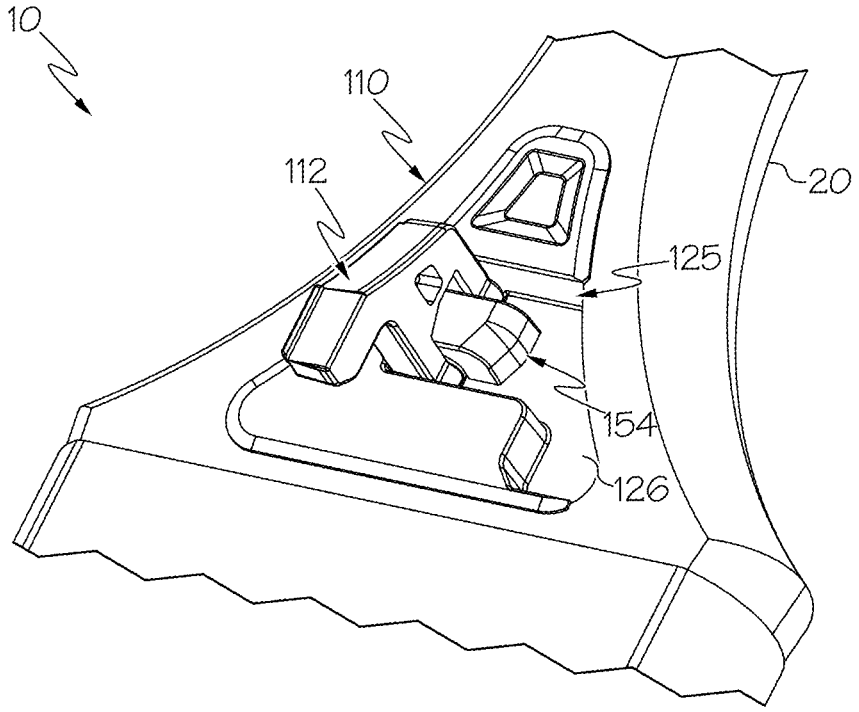
FIG. 5 is an enlarged view of the hanger assembly with the hanger in an extended or deployed position.
Figure 6:
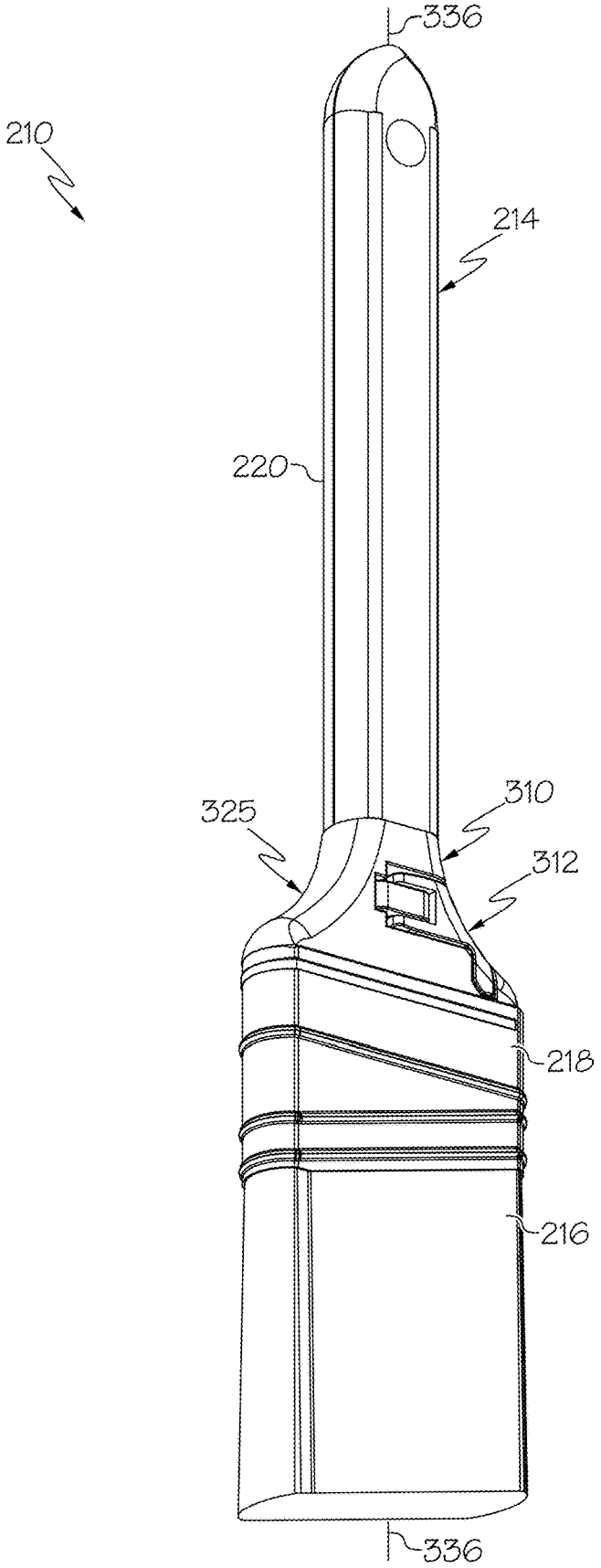
FIG. 6 is a perspective view of another exemplary paint brush with integrated hanger assembly according to another embodiment of the present disclosure.

Referring to FIGS. 1-5, an exemplary paint brush 10 according to an embodiment of the present disclosure is shown. The paint brush 10 generally includes a handle 14 and bristles 16 (also referred to as filaments 16) that are operatively coupled to the handle 14. The filaments 16 may be coupled to the handle 14 in any suitable manner, such as with a metal ferrule 18 in a conventional manner. For example, the filaments 16 may be set in a suitable adhesive, such as an epoxy, that extends into one or more outwardly protruding annular grooves in the inner wall of the ferrule 18 for securely fastening the filaments 16 to the ferrule 18. The filaments 16 may be provided in any shape or form as desired. In exemplary embodiments, the lower ends of the filaments 16 may be progressively longer across the lateral width of the brush 10 to provide an angled brush (as shown), such as typically used for trim work; or the lower ends of the filaments 16 may all be of substantially the same length if desired.

The handle 14 includes at least an upper elongated portion 20 opposite the bristles 16, and a hanger assembly 110 operatively coupled to the upper elongated portion 20 of the handle 14. The hanger assembly 110 includes at least a body part 125 having a surface groove 126, and a hanger 112 that is hinged to the body part 125. In the illustrated embodiment, the hanger assembly 110 is discrete with respect to the upper elongated portion 20 of the handle 14, and is operatively coupled to the upper elongated portion 20 of the handle. The hanger 112 is hinged to the body part 125 such that the hanger 112 is pivotably movable between a retracted position for stowing the hanger in the surface groove 126 and an extended position for extending the hanger 112 from the surface groove 126 for hanging the paint brush from an object, such as a tray or bucket, or any other suitable object, such as a paint can, ladder, or the like as may be desired.

The hanger assembly 110 may be located at any suitable location on the handle 14 to provide improved comfort, ergonomics or other efficiencies or functionality of the design. In the illustrated embodiment, the handle 14 has a relatively flat design, including opposite front and rear flat sides 30, 32, with opposite edges 34, 36 connecting the flat sides 30, 32. A lower portion 22 of the handle 14 toward the bristles 16 is operatively coupled or is integral with the upper elongated portion 20, and is laterally enlarged relative to the upper elongated portion 20 of the handle 14. As shown, the front and rear faces 30, 32 may each having a width that tapers from the lower portion 22 toward an intermediate portion 21 of the handle that is between the upper portion 20 and the lower portion 22.

In exemplary embodiments, the hanger assembly 110 is located in the lower portion 22 of the handle, such as on the front side 18 of the handle 14. As shown, the body part 125 may have a peripheral shape that corresponds to the shape of the lower portion 22 of the handle, in which the body part 125 tapers from a wider lower portion of the body part 125 to a narrower upper portion of the body part 125. The body part 125 may constitute a majority of the lower portion 22 of the front face 18 of the handle. For example, a perimeter of the body part 125 may define a body part area, and a region of the lower portion 22 surrounding the body part 125 may define a bezel area, in which the body part area is greater than the bezel area.

In the illustrated embodiment, the length of the groove 126 and hanger 112 (when stowed) extend in a lateral direction across the front side 18, with the depth of the groove 126 extending in a transverse direction, and a pivot axis 136 being generally centrally located and extending in a longitudinal direction. The hanger 112 includes a first segment 132*a* that extends in a direction transverse to the pivot axis 136, and includes a second segment 132*b* that extends transverse to the first segment 132*a* to form a hook portion 138 that enables the hanger 112 to be securely hanged on an object. The hook portion 138 may be so dimensioned to hang on the edge of conventional (e.g., one-gallon or five-gallon) paint cans, paint cups, paint trays, or the like.

As shown, the groove 126 has a shape that corresponds to a shape of the hanger segments 132*a*, 132*b* of the hanger 112, such that when the hanger 112 is pivotably moved to the retracted position the hanger segments 132 are stowed within the groove 126. In this manner, the groove 126 includes a first groove segment 126*a* that is configured to receive the first segment 132*a* of the hanger portion, and includes a second groove segment 126*b* that is transverse to the first groove segment 126*a* and is configured to receive the second segment 132*b* of the hanger 112. In exemplary embodiments, the hanger 112 is configured to be flush with the outer surface of the body part 125 when in the retracted and stowed position. This enhances the ergonomics of the paint brush and makes the brush more comfortable for the user. It is understood that in this stowed flush state, the hanger 112 may have some minor variation in elevation relative to the outer surface so as to be slightly recessed or protrude from the outer surface of body part 125 without affecting the comfort to the user.

To facilitate engagement and deploying the hanger 112 by the user, a region of the groove 126 that receives the hook portion 138 is larger than the hook portion 138 to provide an access gap 139 adjacent to a portion of the hook portion 138. In this manner, the user can reach into the access gap 139 with their finger to deploy the hanger 112. To further facilitate deploying the hanger 112, the portion of the hook portion 138 adjacent to the access gap may include a lip 141 that enables engagement of the hanger by the user. In addition, the surface groove 126 may extend to an edge of the body part 125 to form an open region 143 at the edge, such that the hook portion 138 of the hanger, when in the stowed position, is accessible at the open region 143 at the edge. In exemplary embodiments, the hanger 112 includes a connection portion 137 that is hinged to the body part 125 with a connector 154. As shown, the hanger 112 includes a pivot 157 operatively coupled to the hook portion 138, and the connector 154 cooperates with the pivot 157 to pivotably couple the hanger to the body part 125.

As shown in the illustrated embodiment, the pivot 157 is formed as a pivot rod 157 that extends between opposite arms 160 at an end portion of the hanger 112 to form a connection loop. In the illustrated embodiment, the connection loop is continuous; however the loop also may be segmented, such as by having the pivot rod 157 or one of the arms 160 as segmented. In exemplary embodiments the hanger 112 has a unitary construction, in which the pivot 157 is unitary with a hook portion 138 of the hanger 112.

In exemplary embodiments, the hinge body 125 includes at least one receiver 167 that is configured to receive at least one portion of the connector 154 to pivotably secure the pivot 157 of the hanger to the body part 125. In exemplary embodiments, the at least one portion of the connector 154 is a projecting segment that extends through the loop of the hanger 112 to operatively couple to the body part 125, and a bridge or cross-member segment interacts with the pivot rod 157 to pivotably secure the hanger to the body part.

In the illustrated embodiment, the at least one receiver 167 is configured as a socket 167, and the at least one portion (projecting segment) of the connector 154 received by the socket 167 is configured as at least one pin 168. As shown, the hinge body 125 includes a pair of laterally spaced apart sockets 167 that open to a mounting face of the hinge body 125 for receiving corresponding laterally spaced apart pins 168. As shown, the pins 168 extend from a bridge or cross-member portion 171 of the connector 154. The cross-member portion 171 spans between the opposing pins 168 and across the pivot 157 to interact with the pivot rod 157 to permit pivotable movement of the hanger 112.

In the illustrated embodiment, the receiver(s) 167 (e.g., sockets) of the body part 125 receive and secure the portion(s) (e.g. the pins 168) of the connector 154 with a friction fit. For example, the pins 168 may be slightly oversized relative to the sockets 167 such that the pins 168 and/or sockets 167 slightly deform (e.g., either with elastic or plastic deformation) to frictionally and/or resiliently engage each other with sufficient force to hold the connector 154 to the body part 125. In this manner, the connector 154 may be press-fit into hinge body 125. In exemplary embodiments, the sockets 167 have a polygonal-shaped cross-section, such as a hexagonal shaped cross-section, that receive pins 168 with a round cross-section. Such hexagonal-shaped sockets 167 may be easier to displace (deform) and frictionally hold the pins 168 compared to round sockets with round pins. The hinge body 125 and the connector 154 (and/or the hanger 112) may be made of the same material (e.g., polypropylene).

As shown, the mounting face of the body part 125 may have a curved, generally U-shaped recess 178 that may receive a portion of the pivot 157. The cross-member portion 171 also may have a U-shaped recess 179 for receiving a portion of pivot 157. Such U-shaped features may further facilitate the flushness and ergonomics of the design while further facilitating the pivoting function of the hanger 112 and facilitating flushness of the design.

In the illustrated embodiment, the handle 14 includes laterally enlarged lower portion 22 that is unitary with the elongated upper portion 20. The laterally enlarged lower portion 22 includes a pocket 50 within which the hanger assembly 110 is operatively coupled so as to operatively couple the hanger assembly 110 to the upper elongated portion 20. The hanger assembly 110 may be operatively coupled within the pocket 50 in any suitable manner, including through the use of mechanical features, adhesives, sonic welding, or any other suitable technique, such as overmolding the body part 125 within the pocket 50. In the illustrated embodiment, the body part 125 forms a base of the assembly 110, which includes a projection 190 on its rear side that is fit within a recess 52 within the pocket 50. Again, suitable adhesives may be used to secure the assembly 110 within the pocket 50.

In the illustrated embodiment, the upper elongated portion and the laterally enlarged lower portion of the handle are made of wood. The pocket 50 is milled into the wood handle. The assembly 110 is made of plastic components, which may be injection molded from a suitable plastic, preferably a rigid polymer. For example, the hanger 112, body part 125 and connector 154 may be made of a thermoset or thermoplastic polymer, such as polypropylene (PP), polyamide (PA), polyoxymethylene (POM), or polycarbonate (PC), or any other suitable material. The parts of the assembly 110 may be made of the same material or different materials. and wherein the hanger assembly is made of plastic.

FIGS. 6-11 show another exemplary embodiment of a paint brush 210, or components thereof. The paint brush 210 is similar to the above-referenced paint brush 10, and consequently the same reference numerals but indexed by 200 are used to denote structures corresponding to similar structures in the paint brushes 10, 210. Accordingly, the foregoing description of the paint brush 10 is equally applicable to the paint brush 210, except as noted below. In addition, it is understood that aspects of the paint brushes 10, 210 may be substituted for one another or used in conjunction with one another where applicable.

Similarly to the paint brush 10, described above, paint brush 210 includes handle 214 having at least an upper elongated portion 220 opposite bristles 216, and a hanger assembly 310 operatively coupled to the upper elongated portion 220 of the handle 214. The hanger assembly 310 includes at least a body part 325 having a surface groove 326, and a hanger 312 that is hinged to the body part 325, in which the hanger assembly 310 is discrete with respect to the upper elongated portion 220 of the handle, and is operatively coupled to the upper elongated portion 220 of the handle. The hanger 312 is hinged to the body part 325 such that the hanger 312 is pivotably movable between a retracted position for stowing the hanger in the surface groove 326 and an extended position for extending the hanger 312 from the surface groove 326 for hanging the paint brush from an object, such as a tray or bucket, or any other suitable object, such as a paint can, ladder, or the like as may be desired.

In the illustrated embodiment, the body part 325 of the hanger assembly 310 includes an inner part 302 and an outer part 304 at least partially overlying the inner part 302. The outer part 304 includes the surface groove 326, and the hanger 312 is pivotably secured to the inner part 302. More particularly, as shown in the illustrated embodiment, the outer part 304 includes an opening 327 in the surface groove 326 that exposes a mounting region of the inner part 302. The hanger 312 is pivotably secured to the mounting region of the inner part 302 via a connector 354, such that the hanger is pivotably movable between the retracted position and the extended position.

Similarly to the hinged connection of the paint brush 10, the paint brush 210 includes at least one receiver 367 in the body part 325 that is configured to receive at least one portion (hidden from view) of the connector 354 to pivotably secure the pivot 357 of the hanger 312. The connector 354 and construction of the hanger 312 and interaction with body part 325 may be substantially the same as that described above, in which at least one segment of the connector 354 (e.g., pin; cf. pin 168) extends through the loop of the hanger 312 to operatively couple to the body part 325, and more specifically the inner part 302 of the body part 325 via a socket 367 with a friction fit, for example. The inner part 302 of hinge body includes a pair of laterally spaced apart sockets 367 for receiving corresponding laterally spaced apart pins (cf. 168), in which cross-member portion 371 spans between the opposing pins 368 and across the pivot 357 to interact with the pivot rod 357 to permit pivotable movement of the hanger 312.

Figure 7:
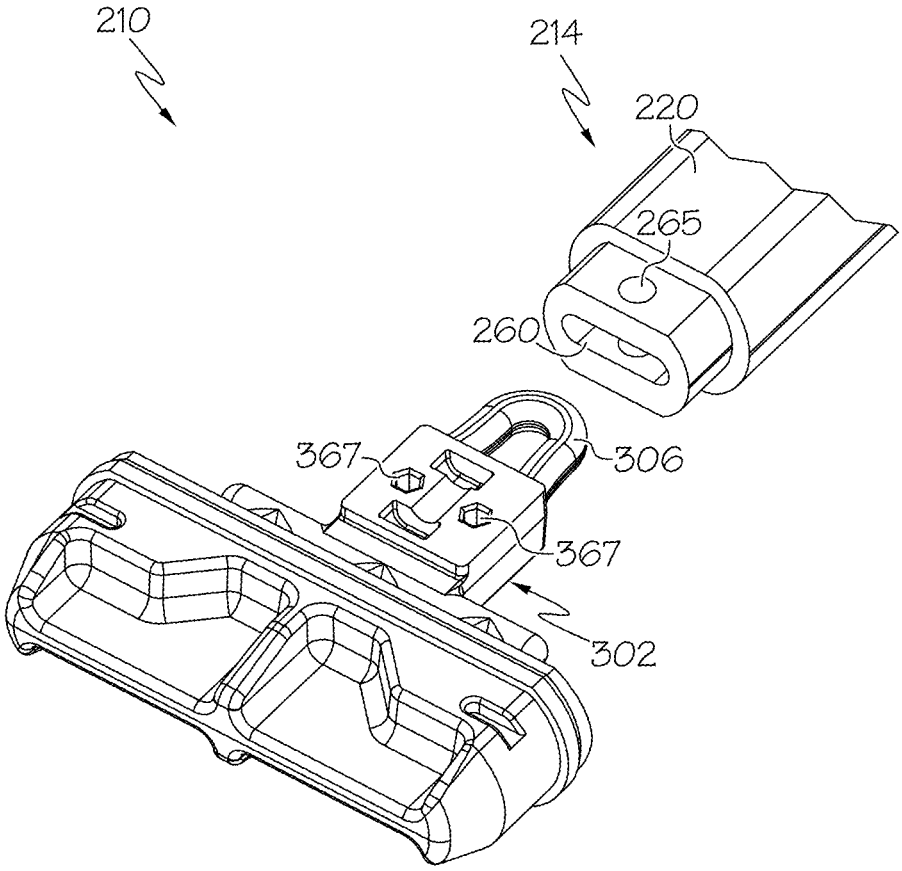
FIG. 7 is an enlarged exploded view of part of the hanger assembly in FIG. 6.
Figure 8:
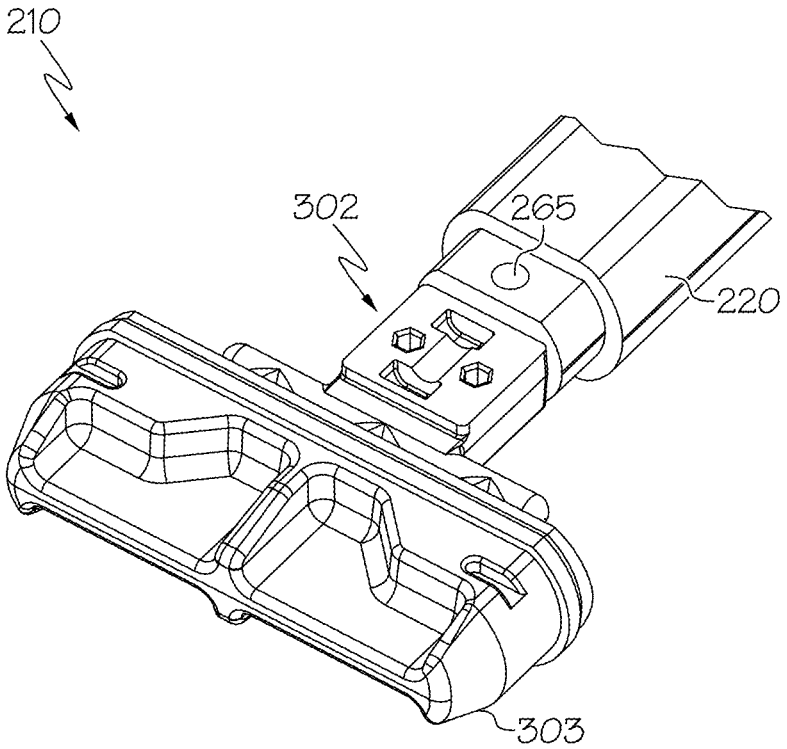
FIGS. 8-10 show an exemplary assembly of the hanger assembly in FIG. 6.

As shown in the illustrated embodiment, particularly with reference to FIGS. 7 and 8, the elongated upper portion 220 of the handle includes a receiver 260, and a portion of the inner part 302 (or the outer part (not shown in this embodiment)) of the body part 325 is received by the receiver 260 for operatively coupling the hanger assembly 310 to the upper elongated portion 220 of the handle. More particularly, in the illustrated embodiment, the upper elongated part 220 includes a slot 260 as the receiver 260, and the inner part 302 includes a projection, such as a looped segment 306, that is received in the slot 260 for operatively coupling the hanger assembly 310 to the handle. As shown in the illustrated embodiment, the slot 260 may be located at an end face of the elongated upper portion 220 of the handle, within which the projection (e.g., looped segment 306) is received.

Figure 9:
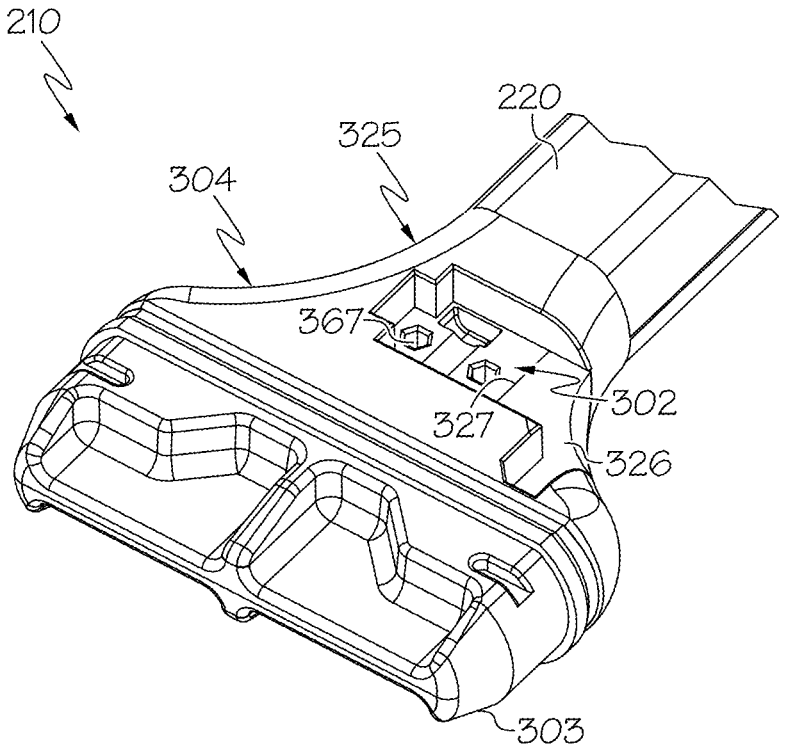
Figure 10:
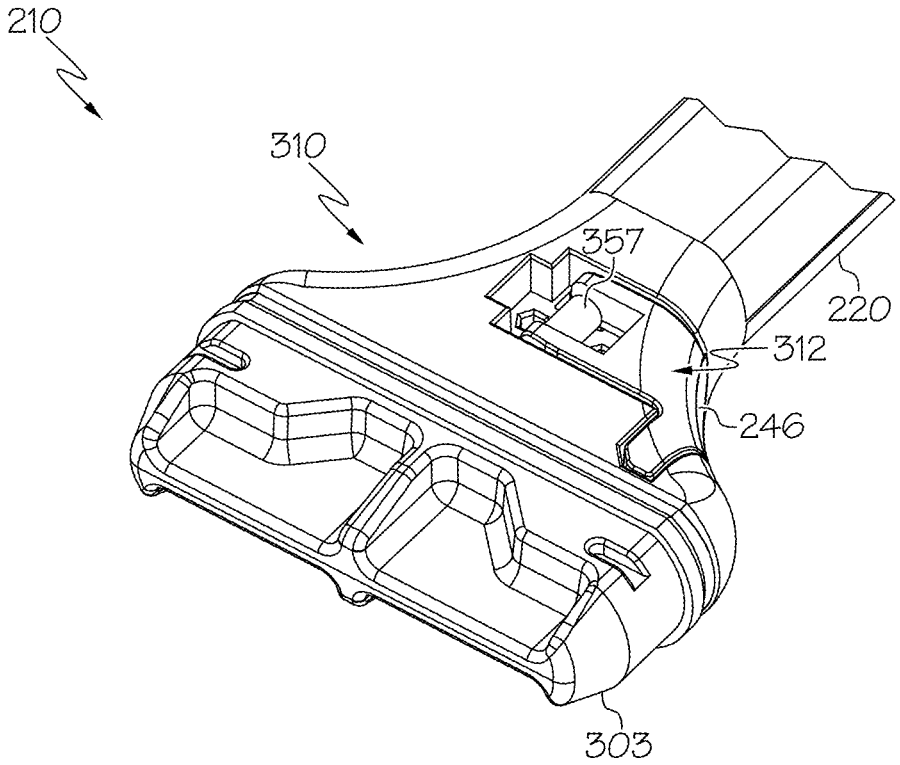

Referring particularly to FIGS. 8 and 9, the outer part 304 is overmolded onto the inner part 302 after the projecting portion (e.g., looped segment 306) is fit within the slot 260. The overmolding is performed such that the outer part 304 includes opening 327 in the surface groove 326 that exposes the mounting region of the inner part 302 for securing the connector 354 via the sockets 367. The overmolding also may be used to at least partially secure the inner part 302 to the upper portion 220 of the handle. For example, the overmolded material of the outer part 304 may extend through an orifice 265 in the upper elongated part 220 (FIG. 9), and through a receiving portion (e.g., loop of looped segment 306) of the inner part 302 to facilitate such securement.

In the illustrated embodiment, the upper elongated portion 220 of the handle is made of wood and the assembly 310 is made of polymer components, which may be injection molded from a suitable polymers. For example, the hanger 312, body part 325, and connector 354 may be made of a thermoset or thermoplastic polymer. The polymer may be a rigid polymer, such as polypropylene (PP), polyamide (PA), polyoxymethylene (POM), or polycarbonate (PC), or any other suitable material. The parts of the assembly 310 may be made of the same material or different materials. For example, the outer part 304 of body part 325 may be made of a flexible polymer instead of a rigid polymer, such as a thermoplastic elastomer (TPE) material, including thermoplastic rubber (TPR), thermoplastic olefin (TPO), thermoplastic polyurethane (TPU) or thermoplastic vulcanizate (TPV), or any other suitable material. The inner part 302 preferably is made of a rigid polymer, and may include a head portion 303 toward the bristles 216, which may be operatively attached to the head portion 303, such as with ferrule 218.

Figure 11:
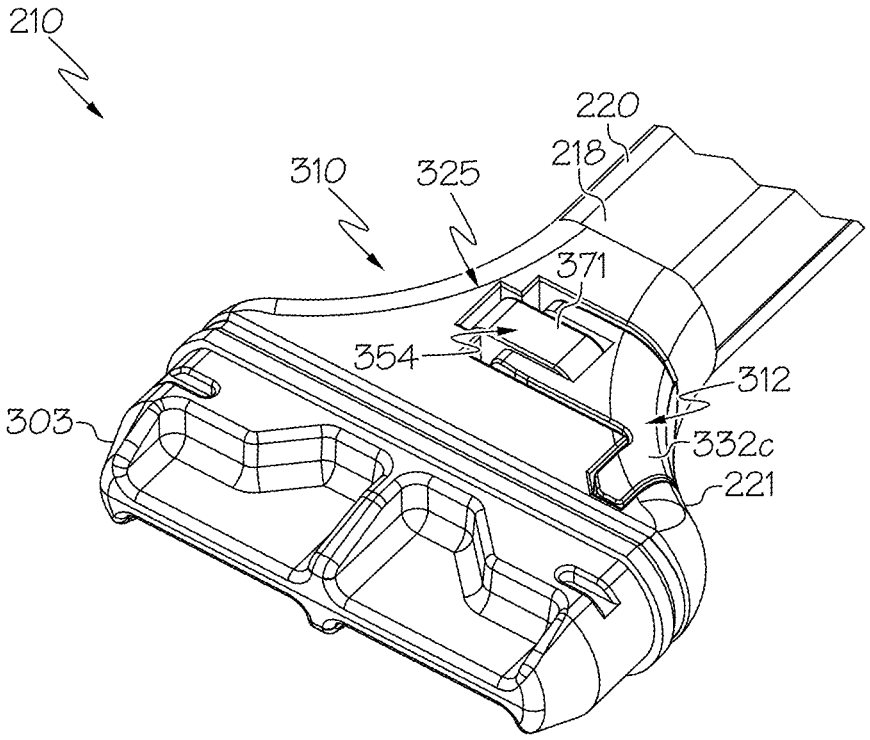
FIG. 11 is an enlarged view of the hanger assembly in FIG. 6 shown with the hanger in a stowed position.

Referring particularly to FIG. 11, the hanger assembly 310 is disposed on the front side 218 of the handle, such that the length of the groove 326 and hanger 312 (when stowed) extend in a lateral direction across the front side 218, with the depth of the groove 326 extending in a transverse direction, and a pivot axis 336 being generally centrally located and extending in the longitudinal direction. In exemplary embodiments, the groove 326 and the hanger 312 extend laterally to the edge 221 (formed by body part 325) for facilitating deployment of the hanger 312 by the user. As shown in the illustrated embodiment, for example, the groove 326 may open to the edge 221 such that a corner 332*c* of the hanger 312 (when stowed) is exposed at the edge 221 for improving access of the hanger 312 to the user. The exposed corner 332*c* of the hanger may be located along the edge 221 of the handle at the curved transition between the upper portion 220 and the lower portion of the handle, where the user's thumb or forefinger are likely to be placed during painting, which further enhances the ergonomics of the design. Also as shown, the transition between the edge 221 of the handle and the front side 218 may have a curved surface. The corner 332*c* of the hanger may be contoured to the shape of a curved surface that connects the edge 221 of the handle with the front side 218 of the handle, and the corner 332*c* also may be contoured to the shape of the curved transition (in the up-down direction) along the edge 221 between the upper portion 20 and enlarged lower portion (which constitutes the part of the body part 325 in the embodiment). Such contouring of the hanger provides a continuous flush interface between the outer surface of the handle and the hanger. In addition, the edge 221 may include an indent 246 below the hanger 312 (when stowed), such as below the corner 332*c* of the hanger, to further provide an access point for enabling the user to deploy the hanger. As shown, a bottom surface of the indent 246 may be formed by a deeper part of the bottom surface of the groove 326 such that the bottom surface of the indent 246 is spaced apart from the hanger when in the retracted and stowed position.

Exemplary paint brush(es) have been shown and described herein, although it is understood that alterations or modifications may be provided based on the understanding of the present disclosure.

According to an aspect of the present disclosure, a paint brush includes: a handle having at least an upper elongated portion; bristles operatively attached to the handle; and a hanger assembly that is discrete with respect to the upper elongated portion of the handle, and is operatively coupled to the upper elongated portion of the handle, wherein the hanger assembly includes: a body part having a surface groove; a hanger hinged to the body part such that the hanger is pivotably movable between a retracted position for stowing the hanger in the surface groove and an extended position for extending the hanger from the surface groove for hanging the paint brush from an object.

According to another aspect of the present disclosure, a paint brush includes: a handle having at least an upper elongated portion; bristles operatively attached to the handle; and a hanger assembly that is discrete with respect to at least the upper elongated portion of the handle, and is operatively coupled to the upper elongated portion of the handle, wherein the hanger assembly includes: a body part having a surface groove; a hanger having a connection portion and a hook portion, the connection portion including laterally spaced apart arms and a pivot rod extending between the laterally spaced apart arms to form a connection loop; and a connector that operatively connects the hanger to the body part and cooperates with the pivot to enable the hanger to pivotably move between a retracted position in which the hanger is stowed in the surface groove and an extended position in which the hanger extends from the surface groove for hanging the paint brush from an object.

Embodiments may include one or more of the following additional features, separately or in any combination.

In exemplary embodiment(s), the handle includes a laterally enlarged lower portion that is unitary with the elongated upper portion, the laterally enlarged lower portion including a pocket, and the body part of the hanger assembly is arranged in the pocket.

In exemplary embodiment(s), the connector interloops with the connection loop and interacts with the pivot to permit pivotal movement of the hanger.

In exemplary embodiment(s), the connector includes laterally spaced apart projecting segments (e.g, pins) that are operatively coupled together by a bridge or cross-member segment (e.g., such as in a U-shape configuration).

In exemplary embodiment(s), one of the projecting segments of the connector extends through the connection loop of the hanger to operatively couple to the body part, and the cross-member segment interacts with the pivot rod to pivotably secure the hanger to the body part.

In exemplary embodiment(s), the body part includes at least one receiver; and wherein a portion of the connector is received by the at least one receiver of the body part to pivotably secure the hanger to the body part.

In exemplary embodiment(s), the at least one receiver includes a socket, and wherein the portion of the connector includes a pin that is received in the socket.

In exemplary embodiment(s), the pin is frictionally secured in the socket.

In exemplary embodiment(s), the connection loop is segmented or continuous.

In exemplary embodiment(s), the surface groove extends to an edge of the body part to form an open region at the edge, such that the hook portion of the hanger, when in the stowed position, is accessible at the open region at the edge.

In exemplary embodiment(s), a region of the surface groove that receives the hook portion includes a region that is larger than the hook portion to provide an access gap adjacent to a portion of the hook portion, and wherein the portion of the hook portion adjacent to the access gap includes a lip that facilitates engagement of the hanger by a user.

In exemplary embodiment(s), the handle tapers from the laterally enlarged lower portion to the elongated upper portion, and wherein the body part has a corresponding peripheral shape that tapers from a wider lower portion of the body part to a narrower upper portion of the body part.

In exemplary embodiment(s), a perimeter of the body part defines a body part area, and a region of the laterally enlarged lower portion surrounding the body part defines a bezel area, in which the body part area is greater than the bezel area.

In exemplary embodiment(s), the surface groove has a shape that corresponds to a shape of a hanger portion of the hanger, such that when the hanger is pivotably moved to the retracted position, the hanger portion is stowed within the surface grove and is flush with an outer surface of the handle having the surface groove.

In exemplary embodiment(s), the hanger portion includes a first segment that extends in a direction transverse to a pivot axis of the pivot, and the hanger portion includes a second segment that extends transverse to the first segment to form a hook.

In exemplary embodiment(s), the surface groove includes a first groove segment that is configured to receive the first segment of the hanger portion, and includes a second groove segment that is transverse to the first groove segment and is configured to receive the second segment of the hanger portion.

In exemplary embodiment(s), the hanger extends in a direction transverse to a longitudinal axis of the elongated portion, and wherein the hanger assembly is configured such that the hanger pivots about a pivot axis that is parallel or coaxial to the longitudinal axis of the elongated portion of the handle.

In exemplary embodiment(s), the upper elongated portion and the handle is made of wood.

In exemplary embodiment(s), the laterally enlarged lower portion and the handle is made of wood.

In exemplary embodiment(s), the hanger assembly is made of plastic.

According to another aspect, a paint brush includes: an elongated handle having a flat front face, a rear face, and left and right sides respectively connecting the front and rear faces; the respective front and rear faces each having a lower portion, an intermediate portion, and an upper portion; the respective lower portions being wider than the respective intermediate portions; and the front and rear faces each having a width that tapers from the lower portion toward the intermediate portion; bristles operatively attached to the handle with a ferrule; a hanger assembly arranged in a recessed pocket in the lower portion of the flat front face, the hanger assembly comprising: a body part having a surface groove; a hanger having a connection portion and a hook portion, the connection portion including laterally spaced apart arms and a pivot rod extending between the laterally spaced apart arms to form a connection loop; and a connector that operatively connects the hanger to the body part and cooperates with the pivot to enable the hanger to pivotably move between a retracted position in which the hanger is stowed in the surface groove and an extended position in which the hanger extends from the surface groove for hanging the paint brush from an object; wherein the connector includes a pair of pins laterally spaced apart and extending from a cross-member portion of the connector; wherein the body part includes a pair of sockets laterally spaced apart and configured to receive the pair of pins; and wherein the pins are received in the sockets with one of the pins of the connector extending through the connection loop of the hanger, and the cross-member is configured to interact with the pivot rod of the hanger to pivotably secure the hanger to the body part.

According to another aspect, a paint brush includes: a handle having at least an upper elongated portion; bristles operatively attached to the handle; and a hanger assembly that is discrete with respect to the upper elongated portion of the handle, and is operatively coupled to the upper elongated portion of the handle, wherein the hanger assembly includes: a body part having a surface groove; a hanger hinged to the body part such that the hanger is pivotably movable between a retracted position for stowing the hanger in the surface groove and an extended position for extending the hanger from the surface groove for hanging the paint brush from an object; wherein the body part of the hanger assembly includes an inner part and an outer part at least partially overlying the inner part; wherein the outer part includes the surface groove; and wherein the hanger is pivotably secured to the inner part.

Embodiments may include one or more of the following additional features, separately or in any combination.

In exemplary embodiment(s), the outer part includes an opening in the surface groove that exposes a mounting region of the inner part, and wherein the hanger is pivotably secured to the mounting region of the inner part, such that the hanger is pivotably movable between the retracted position and the extended position.

In exemplary embodiment(s), the hanger is pivotably secured to the mounting region via a hinge connector.

In exemplary embodiment(s), the elongated upper portion of the handle includes a receiver, and wherein a portion of the inner part or the outer part of the hanger assembly is received by the receiver for operatively coupling the hanger assembly to the upper elongated portion of the handle.

In exemplary embodiment(s), the upper elongated part includes a slot, and the inner part includes a projection received in the slot for operatively coupling the hanger assembly to the upper elongated portion of the handle.

In exemplary embodiment(s), the slot is located at an end face of the elongated upper portion of the handle.

In exemplary embodiment(s), the outer part is overmolded onto the inner part.

In exemplary embodiment(s), the outer part is overmolded onto the inner part, and wherein the overmolding extends through an orifice in the upper elongated part and through a receiving portion of the inner part to facilitate securement of the inner part of the hanger assembly to the upper elongated part of the handle.

In exemplary embodiment(s), the inner part includes a head portion toward the bristles, and wherein the bristles are operatively attached to the head portion, such as with a ferrule.

In exemplary embodiment(s), the surface groove opens to an edge of the handle, and the hanger when in the retracted position extends to the edge such that a corner of the hanger is accessible at the edge for enabling pivoting of the hanger from the retracted to extended position.

In exemplary embodiment(s), the edge of the handle has an indent portion having a bottom surface that is formed by a deeper part of the surface groove, such that the bottom surface of the indent portion is spaced apart from the hanger portion when in the retracted position.

In exemplary embodiment(s), a curved surface connects the edge of the handle to a front side of the handle having the groove, and wherein the corner of the hanger is contoured to the curved surface of the handle such that the corner of hanger is flush with the curved surface when the hanger is in the retracted position.

According to another aspect, a method of forming a paint brush handle, includes: providing a handle having an elongated upper portion; and operatively coupling a hanger assembly to the handle such that a hanger is hinged to a body part of the assembly for pivotable movement between a retracted position for stowing the hanger in the surface groove and an extended position for extending the hanger from the surface groove for hanging the paint brush from an object.

According to another aspect, the ornamental design for a paint brush as shown and described with respect to any of FIGS. 1-11, in which any portion of the paint brush either via natural delineations or otherwise may be claimed or disclaimed.

As used herein, an "operative" connection, coupling, or the like; or a connection by which entities are "operatively" connected, is one in which the entities are connected in such a way that the entities may perform as intended. An operative connection may be a direct connection or an indirect connection in which an intermediate entity or entities cooperate or otherwise are part of the connection or are in between the operatively connected entities. An operative connection or coupling may include the entities being integral and unitary with each other.

It is to be understood that terms such as "top," "bottom," "upper," "lower," "left," "right," "front," "rear," "forward," "rearward," and the like as used herein may refer to an arbitrary frame of reference, rather than to the ordinary gravitational frame of reference.

It is to be understood that all ranges and ratio limits disclosed in the specification and claims may be combined in any manner, including all values, ranges and subranges between the stated values. It is to be understood that unless specifically stated otherwise, references to "a," "an," and/or "the" may include one or more than one, and that reference to an item in the singular may also include the item in the plural.

The term "about" as used herein refers to any value which lies within the range defined by a variation of up to ±10% of the stated value, for example, ±10%, ±9%, ±8%, ±7%, ±6%, ±5%, ±4%, ±3%, ±2%, ±1%, ±0.01%, or ±0.0% of the stated value, as well as values intervening such stated values.

The phrase "and/or" should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified unless clearly indicated to the contrary. Thus, as a non-limiting example, a reference to "A and/or B," when used in conjunction with open-ended language such as "comprising" can refer, in one embodiment, to A without B (optionally including elements other than B); in another embodiment, to B without A (optionally including elements other than A); in yet another embodiment, to both A and B (optionally including other elements); etc.

The word "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," may refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

The transitional words or phrases, such as "comprising," "including," "carrying," "having," "containing," "involving," "holding," "made from/of," and the like, are to be understood to be open-ended, i.e., to mean including but not limited to.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A paint brush comprising:

a handle having at least an upper elongated portion and a laterally enlarged lower portion that is unitary with the elongated upper portion, wherein the laterally enlarged lower portion includes a pocket;

bristles operatively attached to the handle; and a hanger assembly that is discrete with respect to at least the upper elongated portion of the handle, and is operatively coupled to the upper elongated portion of the handle, wherein the hanger assembly includes:

a body part having a surface groove, wherein the body part is arranged in the pocket of the handle;

a hanger having a connection portion and a hook portion, the connection portion including laterally spaced apart arms and a pivot rod extending between the laterally spaced apart arms to form a connection loop; and a connector that operatively connects the hanger to the body part and cooperates with the pivot to enable the hanger to pivotably move between a retracted position in which the hanger is stowed in the surface groove and an extended position in which the hanger extends from the surface groove for hanging the paint brush from an object.

2. The paint brush according to claim 1, wherein the connector interloops with the connection loop and interacts with the pivot to permit pivotal movement of the hanger.

3. The paint brush according to claim 1, wherein:

the connector includes laterally spaced apart projecting segments that are operatively coupled together by a cross-member segment, and one of the projecting segments of the connector extends through the connection loop of the hanger to operatively couple to the body part, and the cross-member segment interacts with the pivot rod to pivotably secure the hanger to the body part.

4. The paint brush according to claim 1, wherein:

the body part includes at least one receiver; and a portion of the connector is received by the at least one receiver of the body part to pivotably secure the hanger to the body part.

5. The paint brush according to claim 4, wherein the at least one receiver includes a socket, and wherein the portion of the connector includes a pin that is received in the socket.

6. The paint brush according to claim 5, wherein the pin is frictionally secured in the socket.

7. The paint brush according to claim 1, wherein the connection loop is segmented or continuous.

8. The paint brush according to claim 1, wherein the surface groove extends to an edge of the body part to form an open region at the edge, such that the hook portion of the hanger, when in the stowed position, is accessible at the open region at the edge.

9. The paint brush according to claim 1, wherein a region of the surface groove that receives the hook portion includes a region that is larger than the hook portion to provide an access gap adjacent to a portion of the hook portion, and wherein the portion of the hook portion adjacent to the access gap includes a lip that facilitates engagement of the hanger by a user.

10. The paint brush according to claim 1, wherein the handle tapers from the laterally enlarged lower portion to the elongated upper portion, and wherein the body part has a corresponding peripheral shape that tapers from a wider lower portion of the body part to a narrower upper portion of the body part.

11. The paint brush according to claim 1, wherein a perimeter of the body part defines a body part area, and a region of the laterally enlarged lower portion surrounding the body part defines a bezel area, in which the body part area is greater than the bezel area.

12. The paint brush according to claim 1, wherein the surface groove has a shape that corresponds to a shape of a hanger portion of the hanger, such that when the hanger is pivotably moved to the retracted position, the hanger portion is stowed within the surface groove and is flush with an outer surface of the handle having the surface groove.

13. The paint brush according to claim 12, or wherein the hanger portion includes a first segment that extends in a direction transverse to a pivot axis of the pivot, and the hanger portion includes a second segment that extends transverse to the first segment to form a hook.

14. The paint brush according to claim 12, wherein the surface groove includes a first groove segment that is configured to receive the first segment of the hanger portion, and includes a second groove segment that is transverse to the first groove segment and is configured to receive the second segment of the hanger portion.

15. The paint brush according to claim 12, wherein:

the hanger extends in a direction transverse to a longitudinal axis of the elongated portion, and the hanger assembly is configured such that the hanger pivots about a pivot axis that is parallel or coaxial to the longitudinal axis of the elongated portion of the handle.

16. The paint brush according to claim 15, wherein the upper elongated portion and the laterally enlarged lower portion of the handle are made of wood, and wherein the hanger assembly is made of plastic.

17. A paint brush comprising:

an elongated handle having a flat front face, a rear face, and left and right sides respectively connecting the front and rear faces, wherein:

the respective front and rear faces each have a lower portion, an intermediate portion, and an upper portion;

the respective lower portions are wider than the respective intermediate portions; and the front and rear faces each have a width that tapers from the lower portion toward the intermediate portion;

bristles operatively attached to the handle with a ferrule;

a hanger assembly arranged in a recessed pocket in the lower portion of the flat front face, the hanger assembly comprising:

a body part having a surface groove;

a hanger having a connection portion and a hook portion, the connection portion including laterally spaced apart arms and a pivot rod extending between the laterally spaced apart arms to form a connection loop; and a connector that operatively connects the hanger to the body part and cooperates with the pivot to enable the hanger to pivotably move between a retracted position in which the hanger is stowed in the surface groove and an extended position in which the hanger extends from the surface groove for hanging the paint brush from an object;

wherein the connector includes a pair of pins laterally spaced apart and extending from a cross-member portion of the connector;

wherein the body part includes a pair of sockets laterally spaced apart and configured to receive the pair of pins; and wherein the pins are received in the sockets with one of the pins of the connector extending through the connection loop of the hanger, and the cross-member is configured to interact with the pivot rod of the hanger to pivotably secure the hanger to the body part.

* * * * *